US007841889B2

(12) United States Patent
Gerard et al.

(10) Patent No.: US 7,841,889 B2
(45) Date of Patent: Nov. 30, 2010

(54) LOCKING DEVICE FOR A SHIELDED SUB-MINIATURE CONNECTION ASSEMBLY

(75) Inventors: Philippe Gerard, Chennevieres-sur-Marne (FR); Philippe Mallet, Paris (FR)

(73) Assignee: Souriau, Versailles (FR)

( * ) Notice: Subject to any disclaimer, the term of this patent is extended or adjusted under 35 U.S.C. 154(b) by 58 days.

(21) Appl. No.: 12/138,555

(22) Filed: Jun. 13, 2008

(65) Prior Publication Data

US 2008/0318462 A1 Dec. 25, 2008

(30) Foreign Application Priority Data

Jun. 15, 2007 (FR) ..... 07 04272

(51) Int. Cl.
*H01R 13/62* (2006.01)

(52) U.S. Cl. ..... 439/358; 439/607.02

(58) Field of Classification Search ..... 439/358, 439/607.02, 357

See application file for complete search history.

(56) References Cited

U.S. PATENT DOCUMENTS 4,621,885 A * 11/1986 Szczesny et al. ..... 439/357
5,207,593 A 5/1993 Bogiel
5,713,752 A * 2/1998 Leong et al. ..... 439/358
6,010,354 A 1/2000 Cunningham
6,585,536 B1 * 7/2003 Wu ..... 439/358
6,612,860 B2 * 9/2003 Droesbeke ..... 439/357
6,648,666 B1 * 11/2003 Wu ..... 439/352
6,655,979 B1 * 12/2003 Lee ..... 439/357
7,083,459 B1 * 8/2006 Wu et al. ..... 439/354
7,140,917 B1 * 11/2006 O'Halloran et al. .... 439/607.02
2005/0186830 A1 * 8/2005 Wu ..... 439/358

OTHER PUBLICATIONS

Search Report dated Jan. 30, 2008.

* cited by examiner

*Primary Examiner*—Gary F. Paumen
(74) *Attorney, Agent, or Firm*—Perman & Green LLP

(57) ABSTRACT

Locking device for a shielded sub-miniature connection assembly having two sub-miniature connectors with housings made of two molded thermoplastic half-shells, a high contact density miniature sub-assembly with a molded thermoplastic insulating body provided with contact cavities for the positioning and retention of contacts, wherein one of the housings includes on at least one of its faces a movable metal latch able to co-act with a slot made in at least one of the outside faces of the complementary housing.

5 Claims, 4 Drawing Sheets

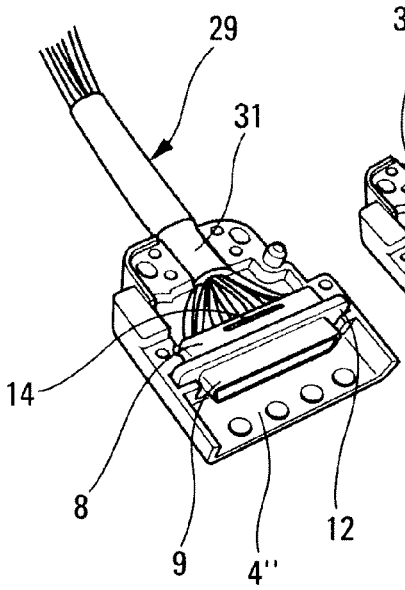
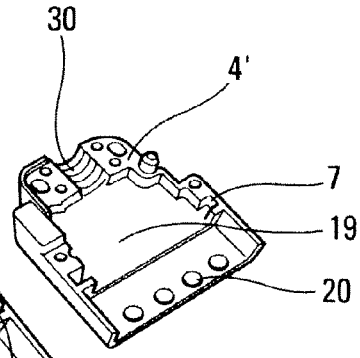
Fig. 6
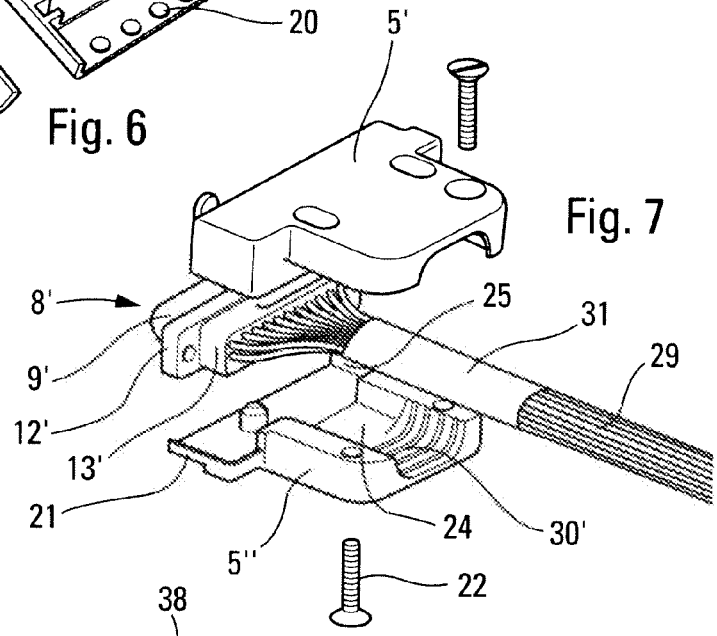
Fig. 7
Fig. 8a
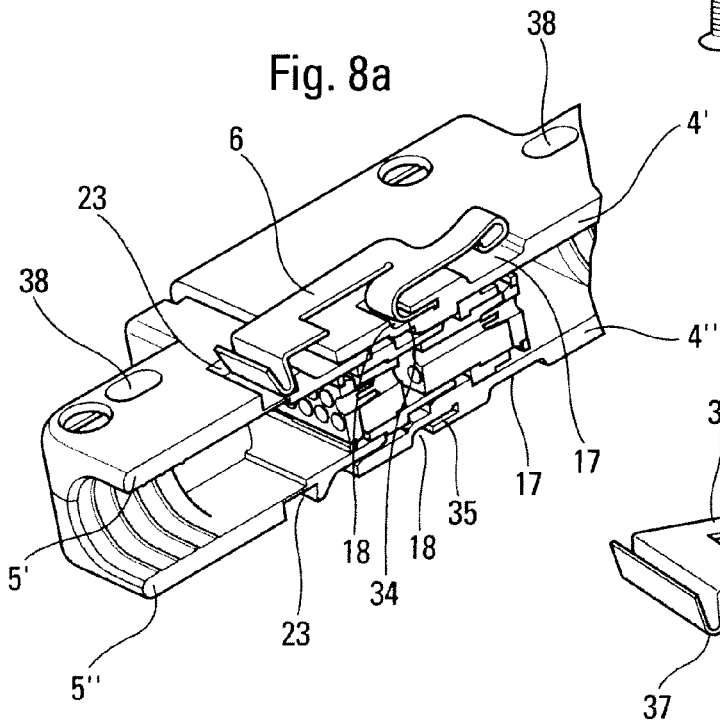
Fig. 8b
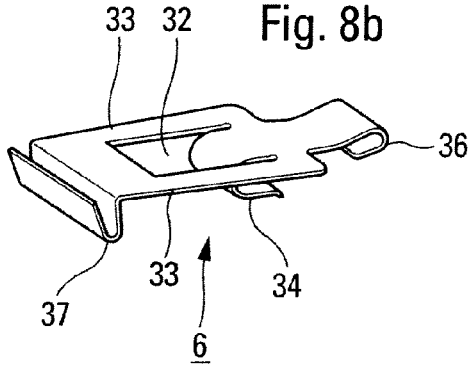

LOCKING DEVICE FOR A SHIELDED SUB-MINIATURE CONNECTION ASSEMBLY

CROSS REFERENCE TO RELATED APPLICATION

This application claims priority to French application number 0704272, filed Jun. 15, 2007, the disclosure of which is incorporated herein by reference in its entirety.

BACKGROUND

1. Field

The aspects of the disclosed embodiments provide a shielded sub-miniature connection assembly and more particularly a connection assembly consisting of two sub-miniature connectors equipped with a locking device for locking the two sub-miniature connectors into a coupled position.

The disclosed embodiments are directed to cable connectors in the field of data processing, of audio-visual communications, of telecommunications and more generally, in fields calling for the processing of multiple signals in a network.

2. Brief Description of Related Developments

In the field of shielded sub-miniature connectors, the utilization is known of an insulating body provided with contact cavities, making possible the positioning and retention of electrical contacts lodged in a shielded housing. The said shielded housing generally consists of two metal half-shells provided with means making it possible for them to be assembled round the insulating body and the strand of wires, which extends the contacts inserted in the insulation. Housings of this type are usually equipped with means of locking, consisting of springs in the form of metal pins fastened to the housing of one of the connectors, which provide the locking of the coupled connectors, locking onto the complementary connector thanks to pin or aperture-type means possessed by the latter. During manufacture the said means are permanently fixed and the locking of the springs on the pins of the complementary connector necessitates an introduction operation, which is difficult for users to perform.

The use is also known of molded thermoplastic housings obtained in presses in which it is proceeded to the operation of duplicate or insert molding of contacts and their associated wires, or of the insulating body equipped with contacts and its associated wires. The said housings comprise an elastic latch obtained during the molding operation. This latch, which is subjected to surface treatment operations on the housing, comprises an elastic link, which shows over time, premature wear due to frequent manipulations. According to this technique, all operations of disassembly either in manufacture with a view to repairs or after commissioning prove to be impossible.

With the development of audio-visual and data-processing techniques, for example those made available to passengers in large civil aviation aircraft, there is a need to create equipment to avoid the difficulties inherent in the products of the prior art and which will make possible the rapid introduction by simple locking of connectors into the assembly and easy disassembly, making it possible to modify the configurations of the networks and the maintenance of equipment.

For this purpose, the aspects of the disclosed embodiments are directed to a locking device for the shielded sub-miniature connection assembly consisting of two sub-miniature connectors comprising housings consisting of two molded thermoplastic half-shells and provided with means of locking for the locking of the two sub-miniature connectors into a coupled position, where one of the housings comprises on at least one of its faces a movable metal latch able to act jointly with a slot made in at least one of the faces of the complementary housing.

SUMMARY

According to one characteristic of the invention, the housing comprises a recess for the positioning of a latch.

According to one of the embodiments of the invention, the latch is a machined metal clip comprising a central cutting defining two elastic branches and an elastic shackle, which is embedded in a compartment after its introduction into the recess via a groove.

According to this embodiment of the invention, the latch additionally comprises an elastic terminal shackle provided at the end resting in the recess in such a way as to improve the mechanical strength of the latch and the recovery of back effects during support on the branches to separate the connectors.

According to one of the characteristics of this embodiment, the latch also comprises a fold sustaining an angle appreciably less than 90° with respect to the plane defined by the horizontal surface of the clip.

According to this embodiment of the invention, the fold is engaged in the slot of the housing so as to retain the connectors firmly in coupled position.

According to the invention, this arrangement makes it possible to use a movable latch, which is removed during the process of nickel coating of the surface of the molded thermoplastic half-shells, making it possible to avoid placing the latch in the treatment baths.

BRIEF DESCRIPTION OF THE DRAWINGS

The invention will be better understood with the help of the description, which follows and the appended drawings where.

FIG. 6 represents a plan view of a cable connector in the process of manufacture;

FIG. 7 shows the stage of assembly of the complementary connector;

FIGS. 8*a*, 8*b* show an embodiment of an assembly latch;

DESCRIPTION OF THE DISCLOSED EMBODIMENTS

Figure 1:
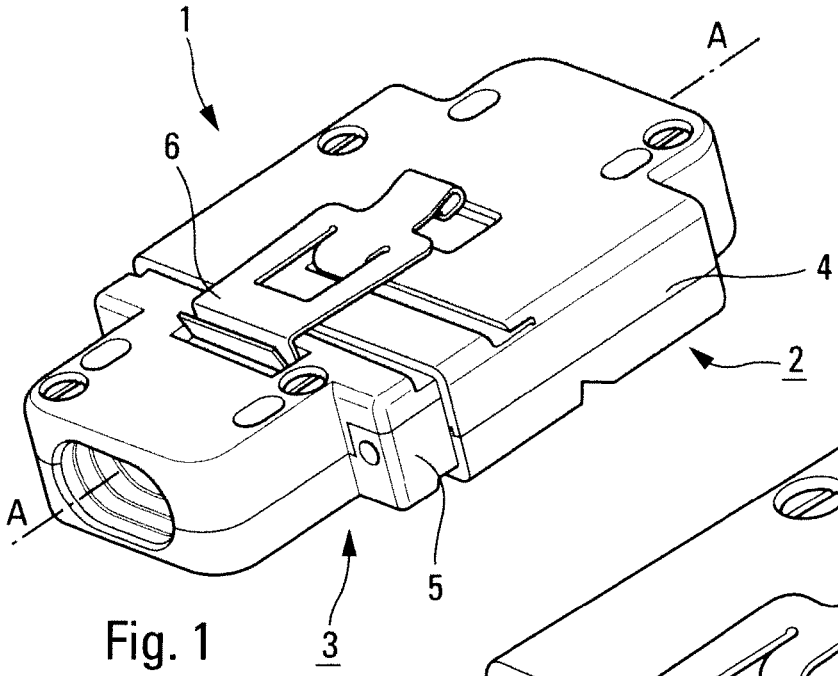
FIG. 1 shows in perspective view a connection assembly 1 according to the disclosed embodiments.

FIG. 1 shows a shielded sub-miniature connection assembly 1 consisting of two sub-miniature connectors 2, 3 comprising housings 4 and 5, consisting of two molded thermoplastic half-shells 4'-4" and 5'-5" coated with nickel protection and provided with complementary means of coupling such as a locking mechanism of the type of latch 6 and such as the means of guidance to make possible the assembly of the connector 2 and its complementary mating connector 3.

The connectors 2 and 3 are likewise equipped with means of retaining contacts. These contacts, which are not shown, may be electrical copper or conducting alloy contacts, optical contacts, or an arrangement comprising different types of terminal.

Figure 2:
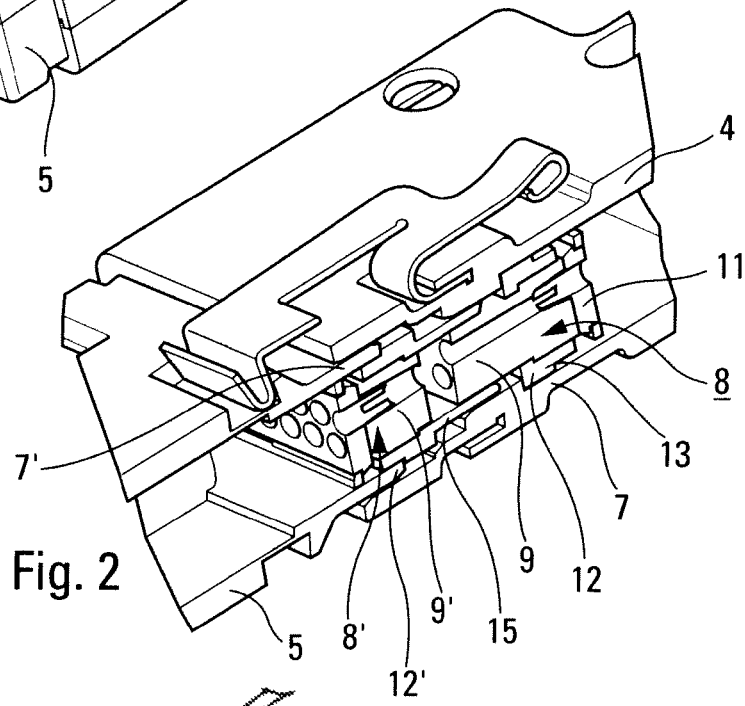
FIG. 2 is a partial section of FIG. 1 along line AA.

The contact-retaining and guidance means, making possible the coupling of the connectors, are shown in FIG. 2, which is a partial perspective section along line AA of FIG. 1.

On the one hand, the housing 4 of the connector 2 comprises a groove 7, whose section is suited to the reception of a sub-assembly or movable module 8, consisting of a high contact density sub-miniature connector, whose front face is formed by a molded thermoplastic insulating body 9 comprising contact cavities 10 for the positioning and retention of contacts, which shall be inserted during the wiring of the module. On the back face of the insulating body 9 is arranged a back or rear plate 11 provided with a contact-retaining clip and whose sidewalls comprise projecting dimples. A molded thermoplastic receptacle shell 12 comprises a flange 13 obtained during the process of molding of the receptacle shell and is provided with oblong apertures 14, into which the projecting dimples of the back plate 11 are locked.

On the other hand, the housing 5 of the complementary connector 3 which comprises a space 7' whose section is suited to the reception of a sub-assembly or a movable module 8' consisting of a high contact density sub-miniature connector comprising the same components as those of the sub-assembly 8 and which is identical, with only two exceptions. The first of these exceptions concerns the insulating body 9', whose front coupling face is located on the level of the plane defined by the upper face of the receptacle shell 12'. The second concerns the flange 15, which is likewise obtained during the process of molding of the receptacle shell, opposite the face comprising the flange 15. This flange 15 serves as a cavity to receive the insulating body 9 during the process of connection of the sub-assemblies 8 and 8' and hence the coupling of the connectors 2 and 3.

The groove 7 and the space 7' constitute the preferred (because easily accessible) positioning sites of the sub-assemblies 8 and 8', after they have been wired or re-wired as will be described below.

Figure 3:
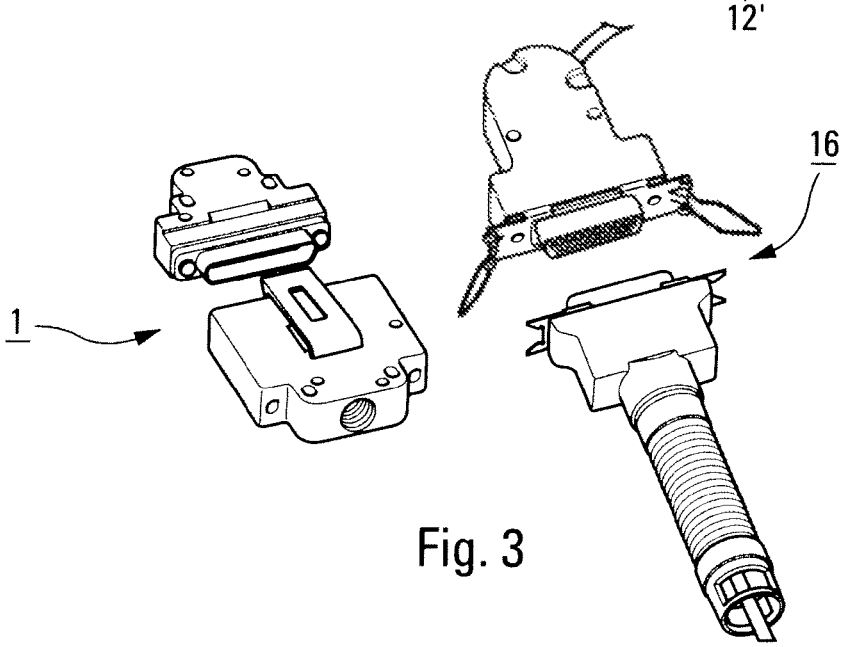
FIG. 3 is a perspective view of an assembly according to the disclosed embodiments and according to the prior art.

FIG. 3 shows on the left a connection assembly 1 of the type of that of the present invention in uncoupled position. On the right of FIG. 3 is shown a connection assembly currently used and usually called Sub-D miniature 16, whose object is that of offering the transmission characteristics of electrical signals close to those furnished by the connection assemblies of the present invention.

The use of movable connection sub-assemblies 8, 8' integrated into the molded thermoplastic nickel-coated half-shells, has led to the surprising result of being able effectively to miniaturize the components of the connection assembly and to gain advantages in terms of both weight and space. In this way, for a Sub-D connection assembly equipped with 25 contacts weighing approximately 60 grams, the invention makes it possible to obtain a weight reduction of approximately 45%, that is to say, to achieve effective results with a total component weight of approximately 33 grams. The position is similar as regards space, since the total length of the coupled assembly 16 is approximately 72.5 mm and the length of assembly 1 of the present invention is approximately 62 mm, a 32% advantage.

It is clear that the disclosed embodiments make it possible to achieve big advantages in terms of space and weight of any equipment used in audiovisual applications, for example those offered to communal transport passengers and more particularly to passengers of large civil aircraft.

Figure 4A:
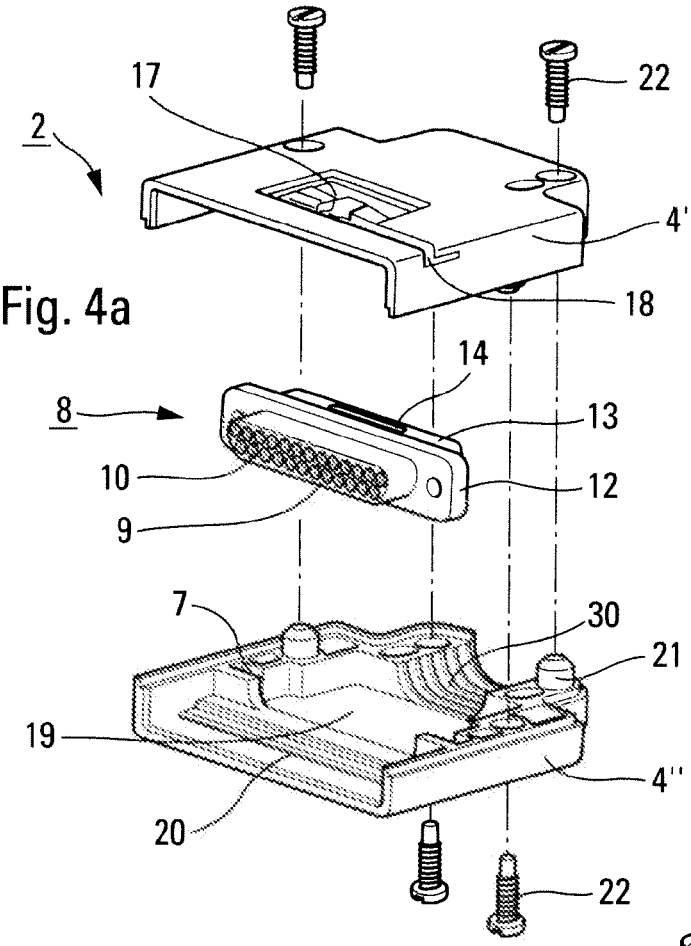
FIGS. 4*a*, 4*b* show a first connector of the connection assembly.

FIG. 4*a* shows an exploded view of components constituting housing 4 of connector 2, which comprises a molded thermoplastic, nickel-clad upper half-shell 4', provided on its upper face with a recess 17 for the positioning of the movable latch 6. A slot 18 extends from one of the edges of the half-shell 4' up to the recess 17, to make possible the positioning of the movable latch 6, being a recess in which the latch will be retained as shall be explained below.

Figure 4B:
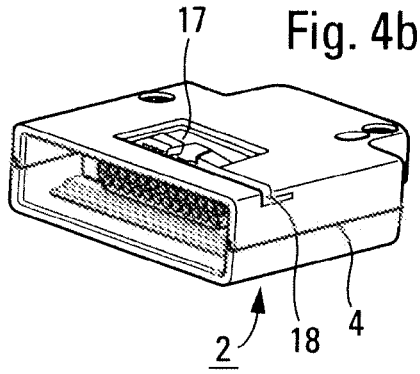

The said half-shell 4' is provided on its inside face with components identical to those shown on the lower half-shell 4", likewise molded from nickel-coated thermoplastic, namely, a groove 7 making possible the positioning of the receptacle shell 12 of the sub-assembly 8, a space 19 making possible the positioning of the cable strand during the process of finishing of the connector 2, steps 20 making possible the guidance of the housing 5 during the process of coupling of connectors 2-3, of the catches 21 for the positioning and fixing of the two half-shells 4', 4" using screws 22, as shown in FIG. 4*b*. As will be seen below, the half-shells are assembled when the sub-assembly 8 has been wired and introduced into the groove 7.

Figure 5B:
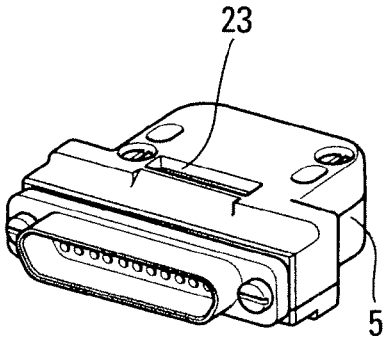
FIGS. 5*a*, 5*b* show a second complementary connector of the connection assembly.
Figure 5A:
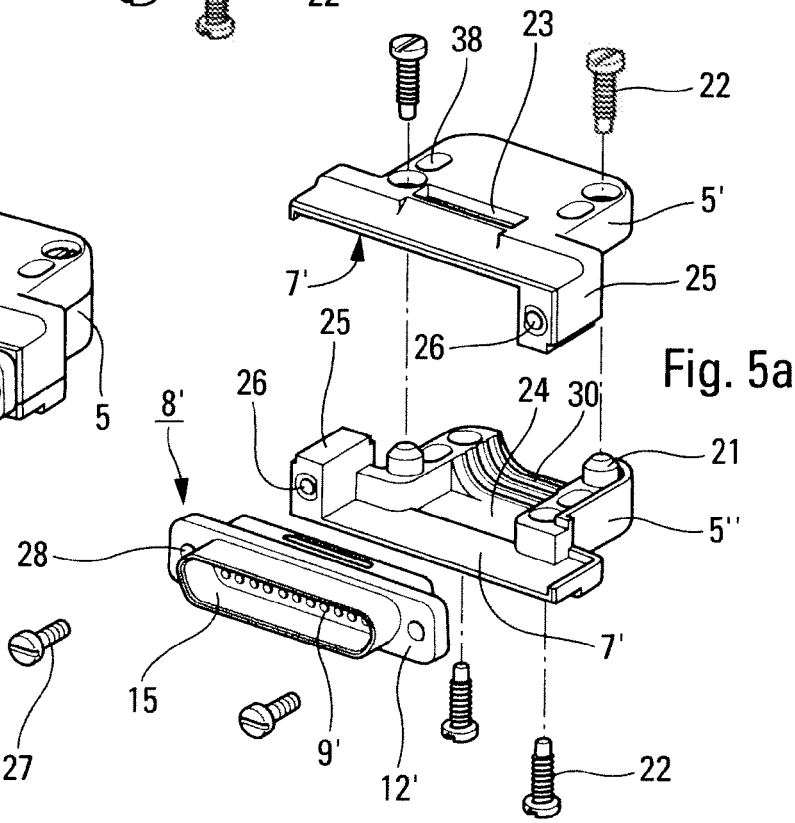

FIG. 5*a* shows an exploded view of components constituting the housing 5 of the connector 3, which comprises a molded thermoplastic nickel-coated upper half-shell 5' provided on its upper face with a slot 23 comprising a projecting edge and acting jointly with the movable latch 6 to lock the connectors 2 and 3.

The said half-shell 5' is provided on its inside face with components identical to those shown on the lower half-shell 5", being likewise of molded thermoplastic and nickel clad, namely, a space 7' making possible the positioning of the receptacle shell 12' of sub-assembly 8', a space 24 making possible the positioning of the strand of cables during the finishing of connector 3, of catches 21 for the relative positioning and fixing of the two half-shells 5', 5" using the screws 22, as shown in FIG. 5*b*. The half-shells 5', 5" comprise at one of their ends, a sidewall 25 comprising on its front face a threaded bore 26, making possible the fixing of the sub-assembly 8' using the screw 27 passing through the apertures 28 made in the receptacle shell 12'. These two identical half-shells thus define the positioning space 7' of the sub-assembly 8' as shown in FIG. 5*b*. As will be seen below, the half-shells are assembled when the sub-assembly 8' has been wired and introduced into the space 7'.

The joint use of molded thermoplastic half-shells shielded by being passed through a surface treatment installation comprising nickel baths, the possibility of assembly and disassembly by screws associated with movable sub-assemblies wired prior to their insertion in the groove and space 7 and 7', makes it possible to obtain a final product, namely, the shielded sub-miniature connection assembly, possessing a very high electrical performance, reduced dimensions, the possibility of replacing modules and easy maintenance.

FIG. 6 shows a connector 2 during the phase preceding the final assembly of a cable connector. A strand 29 of electric wires, whose ends are equipped with crimped contacts, has been wired onto the sub-assembly 8. As can be seen from FIG. 6, the sub-assembly 8 constitutes a miniature connector whose front face is formed by the molded thermoplastic insulating body 9, which comprises contact cavities for the positioning and retention of crimped contacts inserted into the said body. The back face of the insulating body 9 is equipped with a back plate, provided with a contact-retaining clip and enabling the passage through their centre of wire insulators constituting the strand 29. The sidewalls of the plate comprise projecting dimples, which lock into the oblong apertures 14 of the flange of the receptacle shell 12. The receptacle shell 12 is then inserted into the groove 7 of the half-shell 4', the strand 29 is positioned in the space 19 whose front open end is equipped with guidance steps 20 for coupling of connectors 2, 3 and whose open back end constitutes a passage for wire 30 receiving the shielded ferrule 31 of strand 29, in such a way as to ensure the continuity of earth of the strand shield and of the half-shells 4', 4".

FIG. 7 shows a connector 3 during the phase of final assembly of a cable connector. The strand 29 of the electric wires, whose ends are equipped with crimped contacts, has been wired to the sub-assembly 8'. As can be seen from FIG. 7, the sub-assembly 8' constitutes a sub-miniature connector, whose front face is formed by the molded thermoplastic insulating body 9', which comprises contact cavities for the positioning and retention of crimped contacts inserted into that body. The back face of the insulating body 9' is equipped with a back plate equipped with a contact-retaining clip making possible the passage through their centre of wire insulators constituting the strand 29. The sidewalls of the plate comprise the projecting dimples, which lock into the oblong apertures 14 of the flange 13' of the receptacle shell 12'. The receptacle shell 12' is then inserted into the space 7', defined by the half-shells 5, 5' and by the walls 25, the strand 29 is positioned in the space 24 whose open end constitutes a wire passage 30 able to receive a ferrule 31 shielded strand 29, which ensures the continuity of earth of the strand shield and of the half-shells 5', 5". The half-shell 5" is positioned and fixed to the half-shell 5' using the screws 22 and the catches 21.

FIGS. 8*a* and 8*b* show in detail the locking of connectors 2 and 3 assembled using a metal clip forming the movable latch 6 and its mode of fixing in the recess 17 of the upper face of the half-shell 4' as well as its mode of capture in the slot 23 of the upper face of the half-shell 5' when the connectors 2 and 3 are coupled up. It should be noted that in this form of embodiment, a single means of locking is shown on the upper outside face of the half-shells, but it is clear that the lower outside faces are equipped with this type of latch which functions identically on both the upper and lower faces.

The latch 6 in FIG. 8*b* is a clip machined in an elastic metal plate cut and shaped metal plate in such a way as to ensure the retention of the latch and its capture in the complementary connector. A central cut 32 defines two elastic branches 33 and the free part of the metal plate resulting from the cut is folded through 180° to form an elastic shackle 34 embedded after being inserted via the groove 18 in a compartment 35 of the recess 17. An elastic terminal shackle 36 is provided at the end resting in the recess 17, so as to improve the mechanical retention of the latch and the recovery of background effects when an operator presses the branches 33 in order to separate the connectors 2 and 3. The other end of the clip, that is to say that in contact with the complementary connector, is folded on itself and the resulting fold 37 is positioned at an angle appreciably less than 90° with respect to the plane defined by the horizontal surface of the clip, in order to retain the connectors 2 and 3 firmly, thanks to the action of the fold 37 engaged in the slot 23.

This arrangement makes it possible to use a movable latch, which is removed during the process of the nickel coating treatment of the surfaces of the molded thermoplastic half-shells, making it possible not to expose the latch to the treatment baths. The use of a metal latch thus makes it possible to increase the number of coupling/uncoupling maneuvers of the connectors, compared with plastic latches molded simultaneously with the half-shells.

FIG. 8*a* shows the passages 38 made in the back parts of the half-shells 4', 4", 5' and 5", which make possible the passage of the fasteners and the fixing of the housings 4 and 5 of the connectors 2 and 3 into all configurations.

Figure 9:
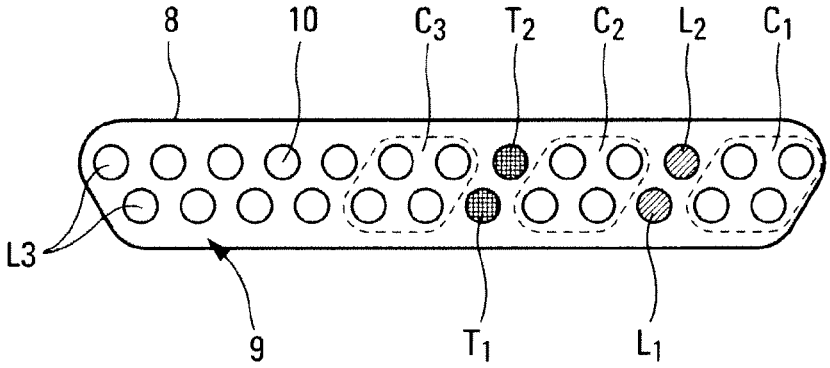
FIG. 9 shows the introduction of a connector equipped with an Ethernet network type cable.

FIG. 9 shows an example of the embodiment of the wiring of a movable module or of sub-assembly 8, 8' using cables of the twisted quad structure type, that is to say, cables making possible the use of very high frequencies, in particular in on-board networks of the type used in avionics.

According to this example of embodiment, the four wires of three cables are inserted in 12 of the 25 contact cavities 10 of the insulating body 9, 9'. In this arrangement, 4 contiguous contact cavities are grouped and referenced C1, C2 and C3 and are separated by the contact cavities T1, T2 or L1, L2, L3, which represent the locations for the earth or ground and the free line contacts.

Figure 10A:
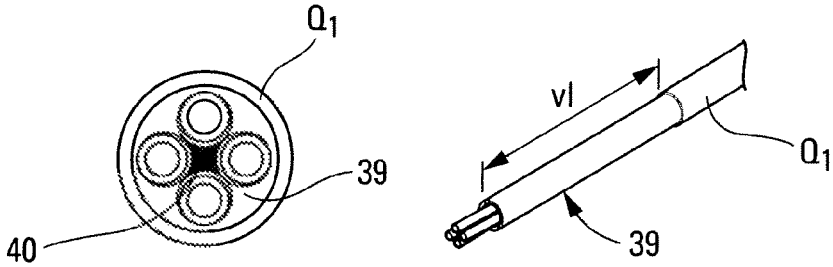
FIGS. 10*a*, 10*b* , 10*c* show the stages of wiring of a connector according to the disclosed embodiments.
Figure 10B:
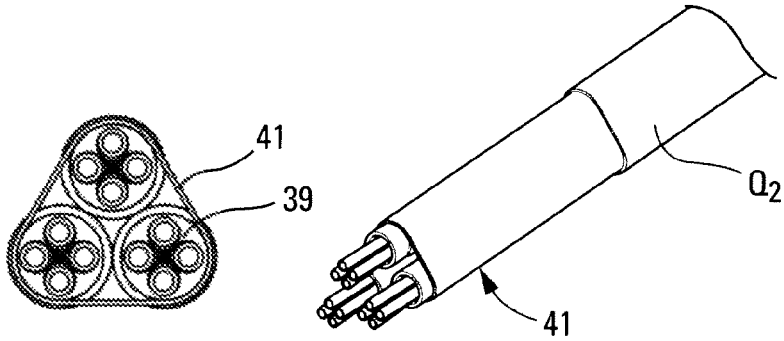
Figure 10C:
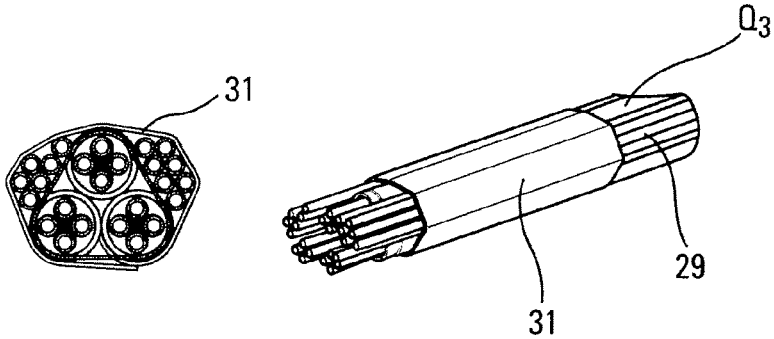

As shown in FIGS. 10 to 10*c*, the process of wiring of a movable module 8 or 8' takes place, for example, in the following phases:

- a first cable Q1 comprising a spacing cross-pin 40, making it possible to eliminate distortions between wires, is arranged between the four wires which compose the cable. The cable is stripped along a length v1, making it possible for each of the wires thus freed to be lodged in the space of the half-shell and stripped along a length of flexible braid 39 of the cable shield;
- each wire is stripped and a contact made from an electricity-conducting material is crimped onto the end of the wire;
- each contact equipped with its wire is inserted into the bore made in a clip of the back plate 11 and positioned in a cavity 10 of the insulating body 9 contiguous to three other contact-receiving cavities of the same cable, for example in C1;
- a second cable Q2 is prepared in the same way and the contacts are positioned in C2;
- a third cable Q3 is prepared in the same way and the contacts are positioned in C3;
- earth contacts are crimped on the flexible braid 39 and positioned in T1 and T2 whilst the wires transmitting the weak signals are equipped with contacts crimped and positioned in free line locations L1, L2 and L3;
- the stripped parts of flexible braids 39 of cables Q1, Q2 and Q3 are grouped and form an assembly of the same potential, thanks to a metal sheet 41 which connects the three flexible braids 39 of cables Q1, Q2 and Q3;
- the earth and the free line wires are arranged round the said sheet 41 and the resulting assembly is covered by a metal sheet connecting the wires and the sheet 41.

The last stage creates a ferrule 31, which makes it possible to provide earth continuity between strand 29 and the shielded housings 4 and 5 of the sub-miniature connectors 2 and 3, that is to say, provide the continuous shield of a sub-miniature connection assembly composing the connection of the cable connectors.

With the movable modules 8, 8' wired in this way it is easy to assemble the connectors 2 and 3 using the method previously described and in particular in the description of FIGS. 6 and 7 above.

The aspects of the embodiments described are not limitative and the variants and modifications made do not breach either the context, or the spirit of the claimed subject matter.

The invention claimed is:

1. A shielded sub-miniature connection assembly comprising:

first and second connectors constructed for engagement in a mating relation, wherein each of said first and second connectors comprises a housing for enclosing connectors mounted therein, said housings being molded of a thermoplastic material shielded by surface treatment;

a latch having a shackle portion;

a recess constructed in an external surface of the housing of the first connector for receiving the latch in a fixed relation, the recess being configured to allow positioning of the latch after a surface treatment of the housings;

a slot constructed in an external surface of the housing of the first connector, the slot being configured to receive the shackle portion of the latch and allow positioning of the latch in the fixed relation with the recess, where the latch is configured to pivot about the shackle portion;

a groove constructed in an external surface of the housing of the second connector, for releasably engaging the latch when the connectors are engaged; and wherein the latch is constructed of a flexible metal and fixed in the recess of the housing of the first connector and extending therefrom to engage the groove of the housing of the second connector, when the connectors are in the mating relation, the latch being configured to engage both the recess and the slot in the housing of the first connector for providing mechanical retention of the latch within the groove of the housing of the second connector.

2. The assembly according to claim 1, wherein the latch is a machined metal clip comprising a central cutting defining two flexible branches and a flexible shackle which is held in the slot after it is positioned in the recess.

3. A locking device for the shielded sub-miniature connection assembly according to claim 2, wherein the latch additionally comprises a flexible terminal shackle which constructed at the end of the latch for engagement in the recess to assist the mechanical retention of the latch in the recess and to provide a memory in the latch to return the latch to a normal position after the separation of the connectors.

4. A locking device for the shielded sub-miniature connection assembly according to claim 1, wherein the latch at an end that extends to engage the second connector additionally comprises a portion folded at an angle appreciably less than 90° with respect to the plane defined by a horizontal face of the latch.

5. A locking device for the shielded sub-miniature connection assembly according to claim 4 wherein the folded portion is engaged in the slot of the housing in such a way as to retain the connectors firmly in a coupled position.

* * * * *